US009865934B2

(12) United States Patent
Sertel et al.

(10) Patent No.: US 9,865,934 B2
(45) Date of Patent: Jan. 9, 2018

(54) ULTRA-WIDEBAND EXTREMELY LOW PROFILE WIDE ANGLE SCANNING PHASED ARRAY WITH COMPACT BALUN AND FEED STRUCTURE

(71) Applicant: THE OHIO STATE UNIVERSITY, Columbus, OH (US)

(72) Inventors: Kubilay Sertel, Hilliard, OH (US); Jonathan Doane, Columbus, OH (US)

( * ) Notice: Subject to any disclaimer, the term of this patent is extended or adjusted under 35 U.S.C. 154(b) by 141 days.

(21) Appl. No.: 13/938,041

(22) Filed: Jul. 9, 2013

(65) Prior Publication Data

US 2014/0009356 A1 Jan. 9, 2014

Related U.S. Application Data

(60) Provisional application No. 61/669,377, filed on Jul. 9, 2012.

(51) Int. Cl.
*H01Q 21/06* (2006.01)
*H01Q 21/00* (2006.01)

(52) U.S. Cl.
CPC ..... *H01Q 21/0006* (2013.01); *H01Q 21/0087* (2013.01); *H01Q 21/062* (2013.01); *Y10T 29/49016* (2015.01)

(58) Field of Classification Search
CPC ..... H01Q 3/24; H01Q 3/242; H01Q 3/245; H01Q 3/247; H01Q 3/26; H01Q 3/2605; H01Q 3/2611; H01Q 3/2617; H01Q 3/2623; H01Q 3/2629; H01Q 3/2635; H01Q 3/2652; H01Q 3/30; H01Q 3/34; H01Q 3/38; H01Q 3/40; H01Q 21/00; H01Q 21/0006; H01Q 21/06; H01Q 21/061; H01Q 21/29; H01Q 21/293; H01Q 5/40; H01Q 5/42; H01Q 5/48; H01Q 5/50; H01Q 21/062; H01Q 1/246; H01Q 9/065; H01Q 9/16; H01Q 9/18; H01Q 9/20; H01Q 9/285
See application file for complete search history.

(56) References Cited

U.S. PATENT DOCUMENTS 4,686,536 A * 8/1987 Allcock ..... H01Q 9/065 343/700 MS
4,914,445 A 4/1990 Shoemaker
6,956,537 B2 * 10/2005 Scherzer ..... H01Q 1/246 343/754

(Continued)

FOREIGN PATENT DOCUMENTS

WO 2011154954 A2 12/2011

OTHER PUBLICATIONS

Munk, B.A., Broadband Wire Arrays, Finite Antenna Arrays and FSS, IEEE Press/Wiley-Interscience, 2003, pp. 181-213.

(Continued)

*Primary Examiner* — Tho G Phan
*Assistant Examiner* — Patrick Holecek
(74) *Attorney, Agent, or Firm* — Standley Law Group LLP

(57) ABSTRACT

A phased array antenna comprising a dielectric superstrate material, a ground plane material, a plurality of dipole structures located between the superstrate and ground plane materials, and a plurality of balun and matching networks in electrical communication with the plurality of dipole structures, wherein the phased array antenna is adapted to achieve a bandwidth of at least about 7:1.

21 Claims, 7 Drawing Sheets

(56) References Cited

U.S. PATENT DOCUMENTS

| | | | | |
|---|---|---|---|---|
| 7,392,021 | B2 | 6/2008 | Jain et al. | |
| 8,325,093 | B2 * | 12/2012 | Holland et al. | 343/700 MS |
| 8,350,774 | B2 * | 1/2013 | Pickles | H01Q 9/16 343/795 |
| 2007/0229385 | A1 | 10/2007 | Deng et al. | |
| 2010/0245202 | A1 | 9/2010 | Lewis et al. | |

OTHER PUBLICATIONS

Kasemodel, J.A. et al., Broadband Planar Wide-Scan Array Employing Tightly Coupled Elements and Integrated Balun, IEEE Int. Symp. on Phased Arrray Sys. and Tech., Oct. 2010, pp. 467-472.

Holland, S. et al., The Planar Ultrawideband Modular Antenna (PUMA) Array, IEEE Trans. Antennas and Prop., Jan. 2012, pp. 130-140, vol. 60, No. 1.

Croswell, W. et al., Wideband Arrays, Modern Antenna Handbook, 2008, pp. 581-629.

Oltman, G., The Compensated Balun, IEEE Transactions on Microwave Theory and Techniques, Mar. 1966, pp. 112-119, vol. 13, No. 17.

Bartholomew, D.M.L., Optimum Design for a Broadband Microstrip Balun, Electronics Letters, Aug. 18, 1977, pp. 510-511, vol. 13, No. 17.

Cavallo, D. et al., PCB Slot Based Transformers to Avoid Common-Mode Resonances in Connected Arrays of Dipoles, IEEE Trans. Antennas and Prop., Aug. 2010, pp. 2767-2771, vol. 58, No. 8.

Tzanidis, I. et al., Excitation and Termination of Finite Tightly Coupled Antenna Arrays Based on Structural Characteristic Modes, presented at Antenna Applications Symposium, Allerton, IL, 2011.

* cited by examiner

ULTRA-WIDEBAND EXTREMELY LOW PROFILE WIDE ANGLE SCANNING PHASED ARRAY WITH COMPACT BALUN AND FEED STRUCTURE

CROSS-REFERENCE TO RELATED APPLICATIONS

This application claims priority to provisional patent application 61/669,377, filed Jul. 9, 2012, which is hereby incorporated by reference in its entirety.

This invention was made with government support under contract no. N68936-09-C-0099 awarded by Naval Air Systems Command. The government may have certain rights in the invention.

BACKGROUND AND SUMMARY OF THE INVENTION

Exemplary embodiments of the present invention relate generally to compact scanning phased array antenna devices.

Tightly Coupled Dipole Arrays (TCDAs) are frequently implemented as a result of their low profile, bandwidths up to 6:1, good scan performance, and low cross polarization characteristics. However, the dipole elements used in TCDAs are balanced structures, and as a result, the feed network for a TCDA must include baluns or 180° hybrids that can sustain array bandwidths of greater than 6:1.

The volume available for such a balun is limited, particularly for designs capable of operating at frequencies above 500 MHz. The known art has not been able to develop a passive balun that supports extremely wide bandwidths (>6:1) while fitting within the limited volume available in each unit cell (typically $<\lambda/10$ in linear dimension at low frequencies). As a result, the known art has not been able to obtain a compact antenna array with a small or low profile and desired performance.

Known TCDA designs use bulky external baluns or hybrids located below the ground plane of the TCDA structure, significantly increasing the total size, weight, and cost of the array. For example, a TCDA operating from 600-4500 MHz may have 30 mm separation ($\sim\lambda/17$ at 600 MHz) between the dipoles and ground plane and the same distance between elements. Practical implementation of a wideband balun that physically fits within this available volume has been a problem, and known designs which physically fit within this available space yield bandwidths of less than 2:1.

An alternative technique, as described in U.S published patent application number 2012/0146869, forgoes baluns altogether and uses vias to mitigate common mode resonances, resulting in 3:1 bandwidth or 5:1 bandwidth with additional external baluns or hybrids located below the ground plane, significantly increasing the total size, weight, and cost of the array.

Described herein are embodiments of a novel design that overcomes such size and performance limitations by exploiting the natural reactance of a compact Marchand balun for use as an impedance matching network for each feed port, eliminating the need for external baluns without compromising the bandwidth of the array. By introducing a network that functions both as a balun and impedance matching network, the bandwidth of an exemplary embodiment of the array may be improved while simultaneously providing a standard 50 ohm unbalanced feed for each element of the array. Other embodiments may, for example, provide impedances in the range of about 25-200 ohm. Embodiments of these networks may be printed on the same substrate as the array itself, thus adding minimal additional cost. Because no external feed circuitry is required in such embodiments, balun/impedance matching networks may be integrated directly onto the substrate, enabling an extremely compact wideband electronically scanned array (ESA). The result is a simultaneous reduction in size and weight and improvement in bandwidth compared to other feeding techniques.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention are directed to networks for use with a wideband scanning array antenna and the associated wideband scanning array antenna structures. Such networks may function both as balun and impedance matching networks while simultaneously improving the array bandwidth and providing a 50 ohm unbalanced feed for each element of the array. Other embodiments may be configured to provide unbalanced feeds with impedances in the range of about 25-200 ohm.

Electrically-small baluns of known designs may exhibit large reactive impedances, limiting their overall bandwidth when implemented. The inventors have discovered that the intrinsic reactance of electrically small Marchand-type baluns may be configured as an impedance matching network to compensate for the reactance of the antenna load and improve the bandwidth of TCDA-type phased arrays. The result may be an incorporation of the balun into the matching network, forming a higher order match. In such configurations, the reactance slope of an electrically small balun may be tuned to increase, rather than decrease, the array bandwidth.

One example of an embodiment of the invention configured using this approach may achieve a 7.6:1 bandwidth at broadside and 6.6:1 bandwidth while scanning to ±45°, with each element fed by a standard 50 ohm unbalanced transmission line. In a second example embodiment configured using the described approach, bandwidths of about 8.9:1 at broadside and about 7.35:1 while scanning to ±45° may be achieved. Other embodiments may be configured to achieve bandwidths up to about 20:1.

Figure 1:
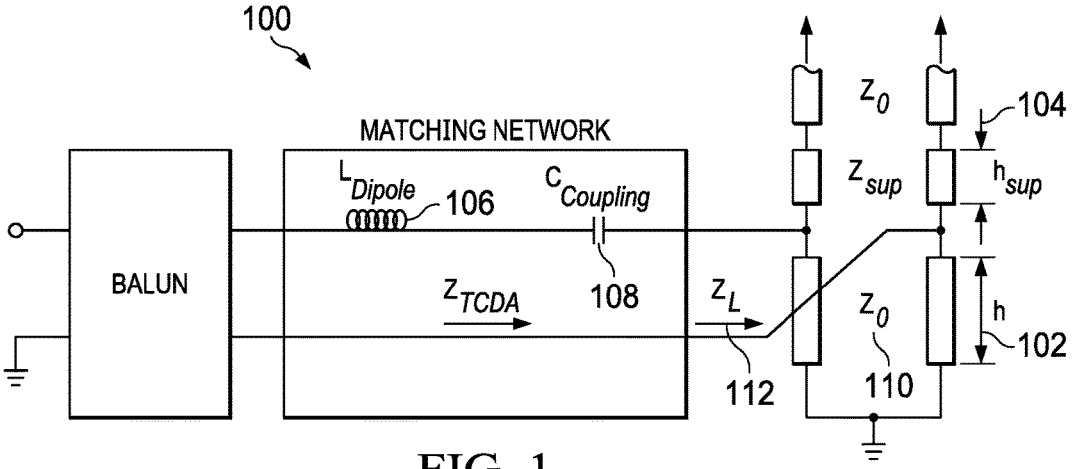
FIG. 1 is a schematic diagram of an equivalent circuit for a known TCDA element.

In known designs, TCDA dipole elements must be fed differentially. In addition, known feed network and power divider designs require unbalanced transmission lines. As a result of this mismatch, a balun may be needed at each TCDA element. An approximate equivalent circuit 100 for the unit cell of a TCDA is shown in FIG. 1 for an array located a height h 102 above a ground plane with a dielectric superstrate of height $h_{sup}$ 104. The inductance of the dipoles is represented by $L_{Dipole}$ 106, and the inter-element capacitance is denoted by $C_{Coupling}$ 108. The aperture radiates via the fundamental Floquet mode, represented by a transmission line with impedance $Z_0$ 110 extending infinitely above the array and short-circuited by the ground plane a distance h 102 below the aperture. A dielectric superstrate slab can be included and is represented by a section of transmission line with impedance $Z_{sup}=Z_0/\sqrt{\in_{sup}}$. Collectively, this transmission line network forms the dipole element impedance $Z_L$ 112. The series L-C circuit created by the dipoles functions as a single stage impedance matching network to the load $Z_L$ 102. With no additional matching, optimization indicates that approximately 4.5:1 bandwidth is possible without a superstrate (VSWR<2:1). This increases to approximately 7:1 bandwidth when a superstrate of $\in_{sup}=1.7$ is added. With additional matching the bandwidth may be increased further. However, $Z_{TCDA}$ is typically approximately 2000, and implementation of a 50 ohm to 200 ohm balun is very difficult. Therefore, compact baluns able to fit within the array unit cell tend to have limited bandwidth.

In an exemplary embodiment, a balun may be incorporated into a matching network, forming a higher order match and enabling a compact TCDA with a practical feed circuit and improved bandwidth. With reference to an exemplary embodiment of an array unit cell in FIG. 3, an example of a Marchand balun constructed from coupled quarter-wave transmission lines may optimally operate over a bandwidth greater than 10:1 if $Z_{Feed}\approx Z_{Bal}$ and $Z_{OC}<<Z_{Bal}<<Z_{SC}$.

Figure 2:
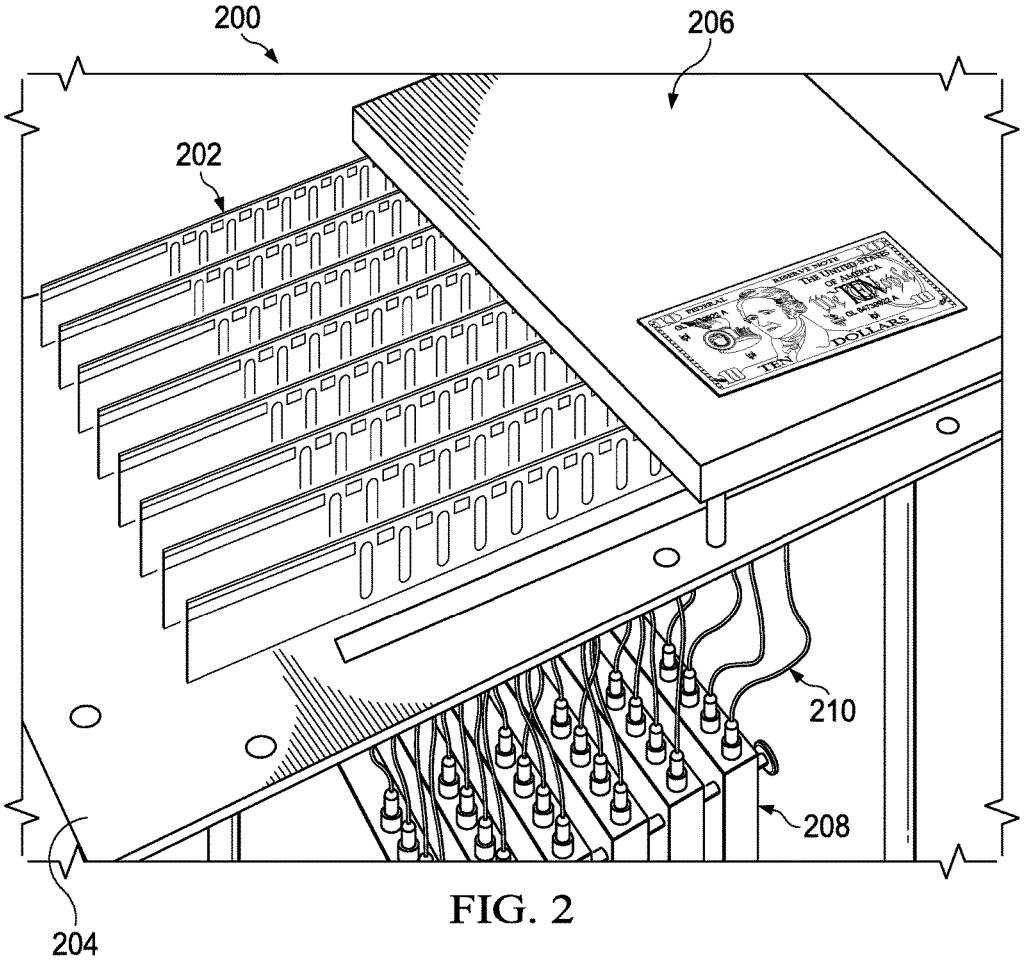
FIG. 2 is a perspective view of an exemplary embodiment of a phased array of the invention.

As is illustrated in FIG. 2, an embodiment of the invention may comprise an array of dipole elements and integrated baluns 202 situated between a ground plane structure 204 and a superstrate 206. In such an embodiment, the superstrate 206 and ground plane structure 204 may be configured such that they are positioned substantially parallel, and such that the edges of the superstrate are aligned with the respective edges of the ground plane structure. Also illustrated is a 64:1 divider network 208. The embodiment of the invention shown in FIG. 1 is illustrated with a section of the superstrate 206 removed so a portion of the dipole element array and integrated baluns 202 may be seen clearly. Other embodiments of the invention may be configured without the superstrate 206.

Figure 3:
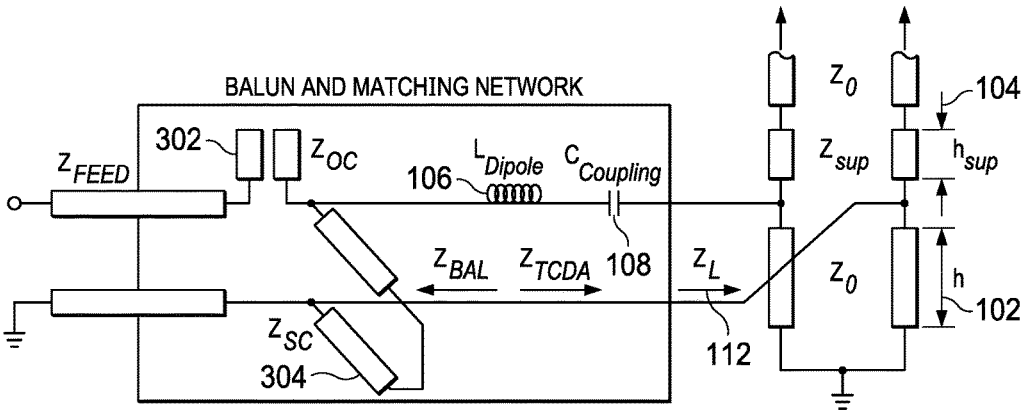
FIG. 3 is a schematic diagram of an equivalent circuit for an exemplary embodiment of an array unit cell of the invention.

Referring to FIG. 3, by adjusting the impedances and lengths of the stubs $Z_{OC}$ 302 and $Z_{SC}$ 304 along with $L_{Dipole}$ 106 and $C_{Coupling}$ 108, a three stage matching network to the dipole element impedance ($Z_L$) 112 may be achieved with at least a 6.75:1 bandwidth for a voltage standing wave ratio (VSWR) of ≥2 when no superstrate 206 is present and at least about 7:1, more preferably at least about 8:1, and still more preferably at least about 8.85:1 bandwidth when a superstrate is present.

A technique to mitigate the impedance mismatch is to reduce the E-plane dimension of the unit cell, which lowers $Z_0$ and $Z_{TCDA}$. In an exemplary embodiment, the balun may then be matched to a $Z_{TCDA}$ of approximately 100 ohm. This technique has the additional benefit of eliminating common mode resonances within the array and balun. Nevertheless, the practical ranges of $Z_{OC}$ and $Z_{SC}$ may create significant reactance within the balun. In embodiments of the invention, this reactance may be exploited to form a matching network for the array.

In such an inventive embodiment, the balun may be de-tuned from the known Marchand design to achieve this bandwidth, however, the output remains balanced over the entire band. As the array scans, the match deteriorates if the array is optimized only at broadside. By re-optimizing the equivalent circuit over the desired scan volume, at least a 7:1 bandwidth may be obtained while scanning to 45° in all planes (VSWR≥2.65). In contrast, a known TCDA without balun yielded a maximum bandwidth of 5.3:1 during testing under identical matching and scanning constraints. As is illustrated by comparing known designs with an inventive embodiment, the balun according to an embodiment of the invention provides not only the required feed structure, but significant bandwidth improvement. In embodiments of the invention, the superstrate dielectric constant may be kept low (e.g., $\in_{sup}$ of approximately 1.7) to avoid power loss at certain scan angles (i.e., scan blindness).

Figure 4:
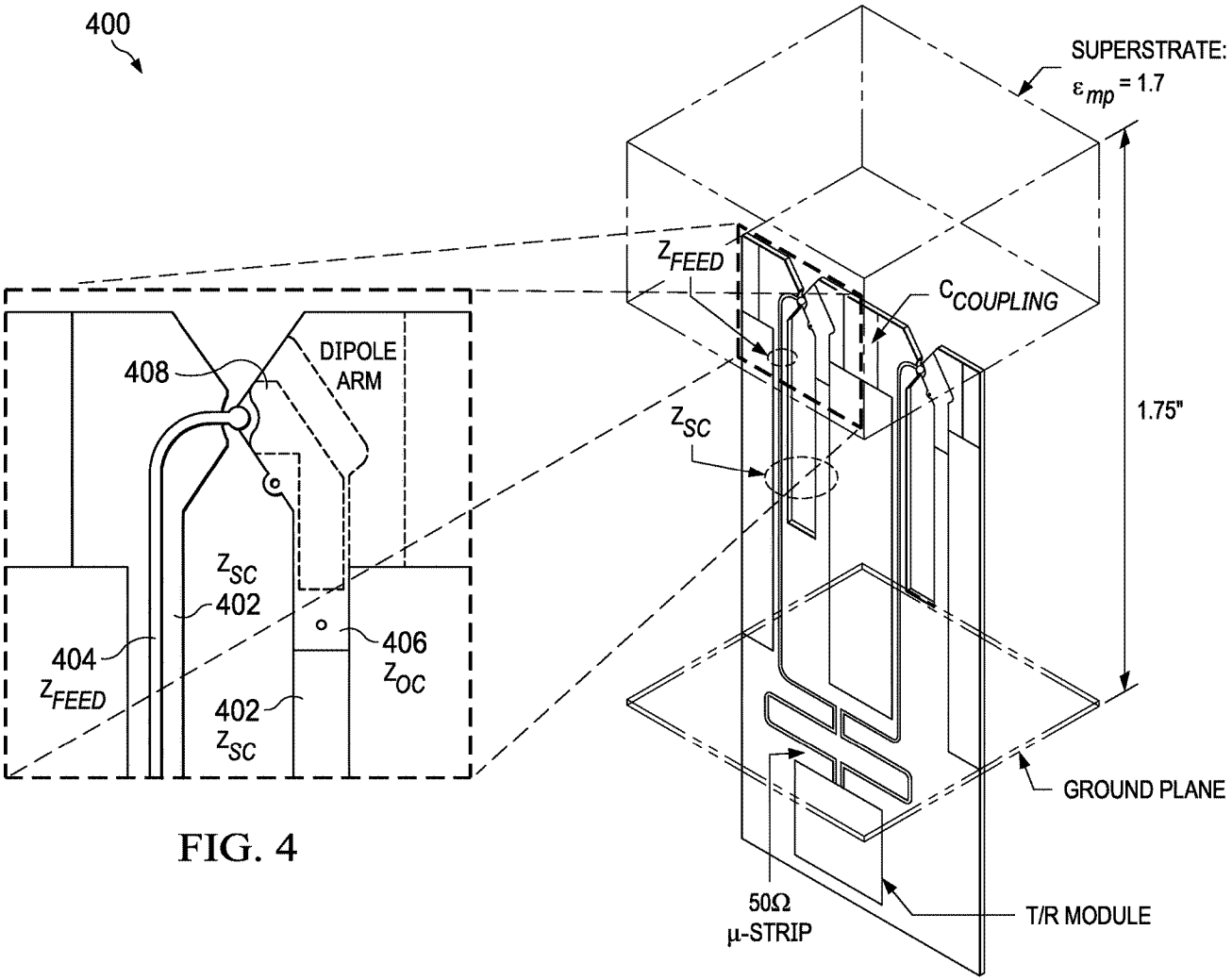
FIG. 4 is a schematic illustration of an exemplary embodiment of an array unit cell.

Referring to FIG. 4, which illustrates a partial embodiment of the dipole array and balun portion 400 of the invention. Both the balun and dipoles are printed on a 3-layer printed circuit board substrate with an $\in_r$ equal to approximately 3.55 with a total thickness of about 0.020" (Rogers 4003, Rogers Corporation, One Technology Drive, Rogers Conn., USA or another suitable material). Although the illustrated embodiment uses a 3-layer printed circuit board substrate, multi-layer printed circuit board materials in addition to 3-layer configurations may be used in other embodiments. The values of $L_{Dipole}$ and $C_{Coupling}$ may be controlled by the thickness and overlap of the dipole arms. In an embodiment of the invention, $Z_{feed}$ may be a 100 ohm microstrip line, whereas $Z_{OC}$ may be implemented in stripline to lower the impedance and reduce unwanted coupling. $Z_{SC}$ may be formed by twin metal strips 402, one of which may also be the ground plane of $Z_{Feed}$ 404. Circuit board vias may connect the upper and lower $Z_{OC}$ 406 grounds and tie the $Z_{Feed}$ trace 404 to the $Z_{OC}$ trace 408. In this example, the width of all printed lines and spaces may be greater or equal to 0.01 inch. In such embodiments, the array and balun may be manufactured using known low cost printed circuit board manufacturing technologies.

Because the E-plane dimension of the unit cell has been reduced, two rectangular unit cells may be combined to form a square "double" element with <λ/2 spacing. By combining the two 100 ohm $Z_{Feed}$s, the "double" element may be fed by a single 50 ohm standard microstrip or coaxial transmission line. Other embodiments may, for example, be configured to be fed by transmission lines with impedances in the range of 25-200 ohm.

Figure 5:
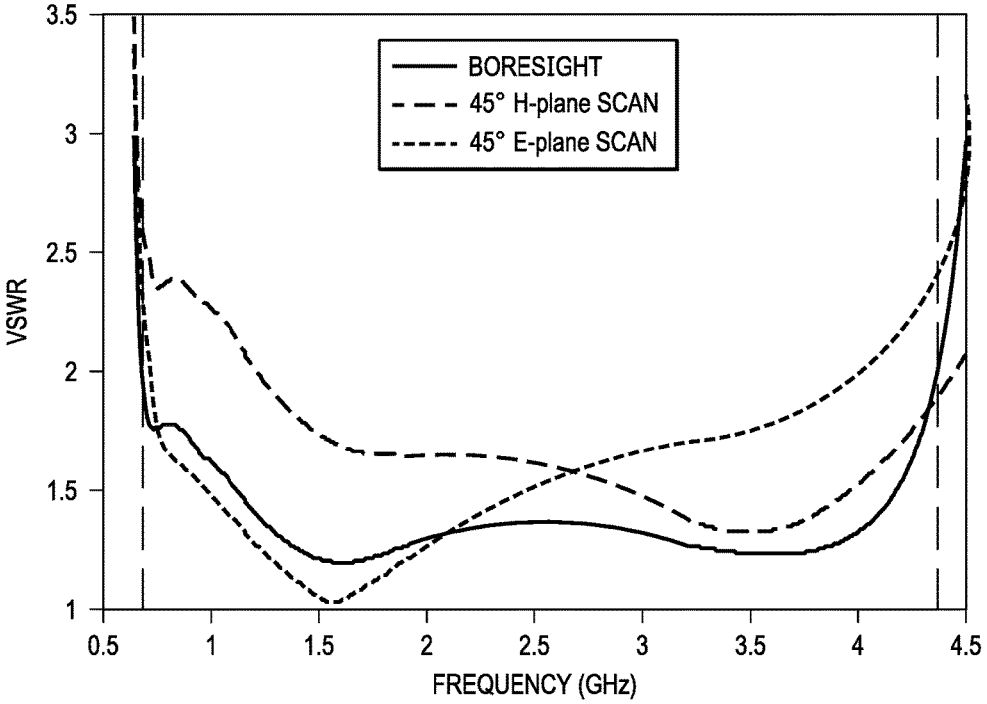
FIG. 5 is a graph of voltage standing wave ratio with respect to frequency for an exemplary embodiment.

Simulation of an embodiment of the inventive TCDA was performed using high frequency structural simulation software (Ansoft HFSS, ANSYS, Inc., 275 Technology Drive, Cannonsburg, Pa., USA or equivalent). As illustrated in FIG. 5, after tuning, an embodiment of the TCDA was demonstrated to achieve 7.35:1 bandwidth (0.68-5.0 GHz) when scanning to 45° in all planes (VSWR≥2.65). Such results confirm the expected performance given by an example of the equivalent circuit model.

The 8×8 prototype array described herein was included as a convenient means to illustrate one embodiment of the invention, including demonstrated results of such an exemplary array. One normally skilled in the art will realize that other array configurations may be implemented while remaining within the scope of the described inventive concept and therefore the disclosed invention should not be limited to such an array configuration.

As is illustrated in FIG. 2, an 8×8 prototype array 200 of an embodiment of the invention was constructed from 64 "double" elements, spaced at approximately 30 mm×30 mm with an overall array height of approximately 45 mm. In the embodiment of the invention shown in FIG. 2, the dipole arms of the edge elements are extended an additional 60 mm. This has the effect of adding 2 rows of short-circuited dipole elements along two sides of the array. Short circuited elements (i.e., extended dipoles) were used to terminate the edges of the array and mitigate edge effects; thus lossy terminations that could have reduced efficiency were avoided. The remaining elements of the array are directly fed by 50 ohm coaxial cables 210. The array 200 sits on a ground plane with dimensions of approximately 12×18 inches 204 and is covered by a 0.5" thick superstrate 206 ($\epsilon_r$=1.7) of approximately the same size as the ground plane. The height of the array 200 is approximately 1¾ inches from ground plane 204 to superstrate 206. In such an embodiment, the dipole elements may be fed by a 64:1 divider network 208 below the array 200. An embodiment of such a divider network 208 may be constructed from nine 8:1 dividers and may be scanned by adjusting the lengths of cables within the network. The prototype array 200 performed very well relative to an ideal periodic model, with an impedance bandwidth of 7.3:1, a broadside gain bandwidth of 7.6:1, a scanning-gain bandwidth of 6.6:1, and a scanning-polarization bandwidth of 6.3:1.

Figure 6:
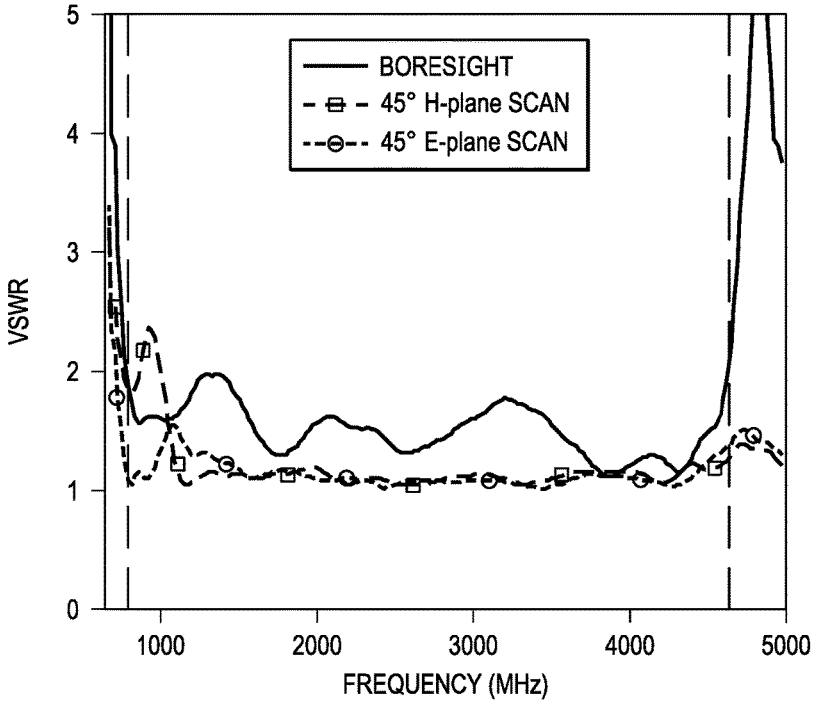
FIG. 6 is a graph of voltage standing wave ratio with respect to frequency for an exemplary embodiment.

The example of array 200 with completely self-contained baluns was demonstrated to function over a 7.6:1 bandwidth (605-4630 MHz) at broadside and 6.6:1 bandwidth (665-4370 MHz) while scanning to ±45° in all planes. FIG. 6 shows the measured VSWR for broadside and 45° scanning in the H and E planes of the inventive embodiment illustrated in FIG. 2 and previously described. Gating was used to remove reflections from the power dividers themselves, and the VSWR has been compensated for the round trip insertion loss of the dividers when collecting the measurements used to produce FIG. 6. The broadside VSWR is less than 2:1 over a 7.3:1 bandwidth (630-4650 MHz). In this example, the scanned VSWR measured is artificially low because the reflections from the elements are not in-phase and are therefore mostly absorbed by the matched combiners.

Figure 7:
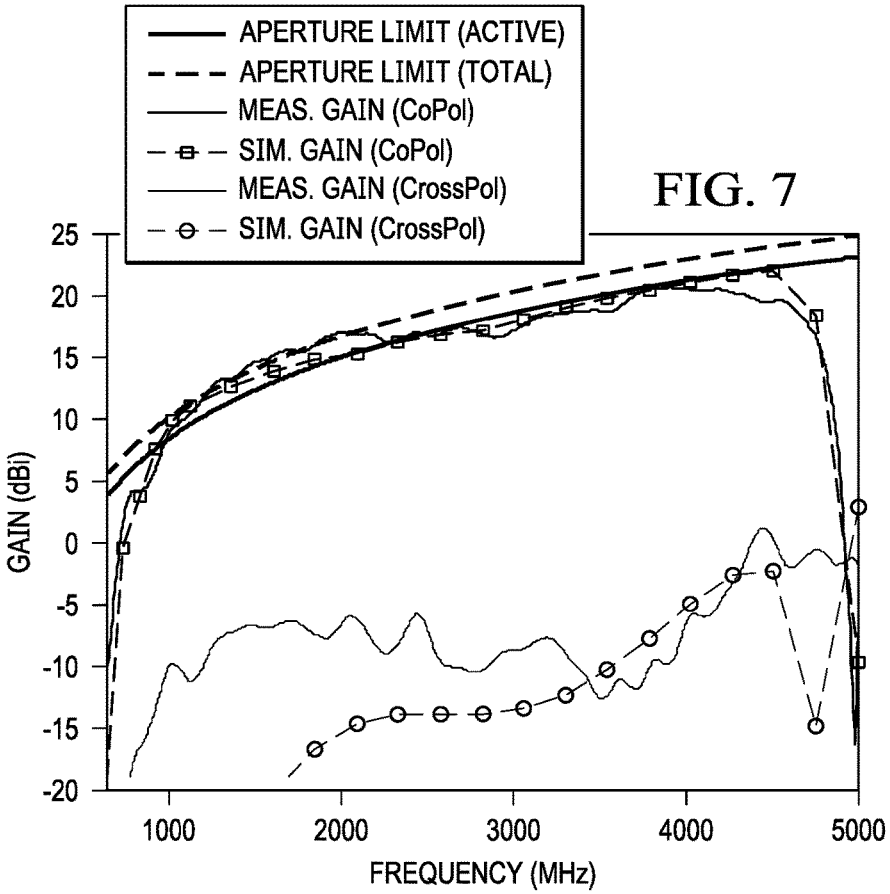
FIG. 7 is a graph of simulated and measured gain with respect to frequency for an exemplary embodiment.
Figure 8:
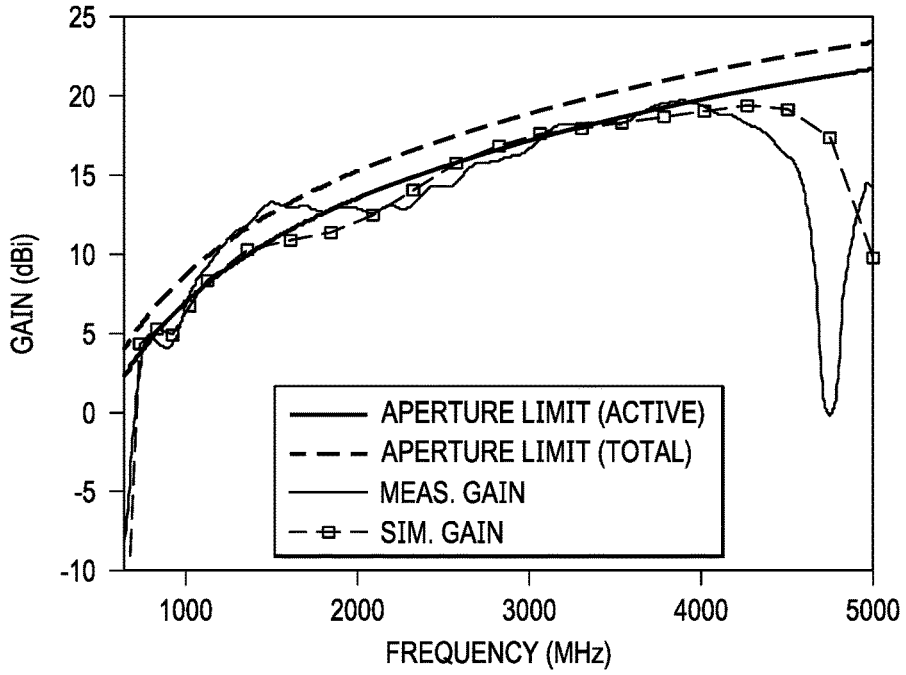
FIG. 8 is a graph of simulated and measured gain with respect to frequency for an exemplary embodiment.
Figure 9:
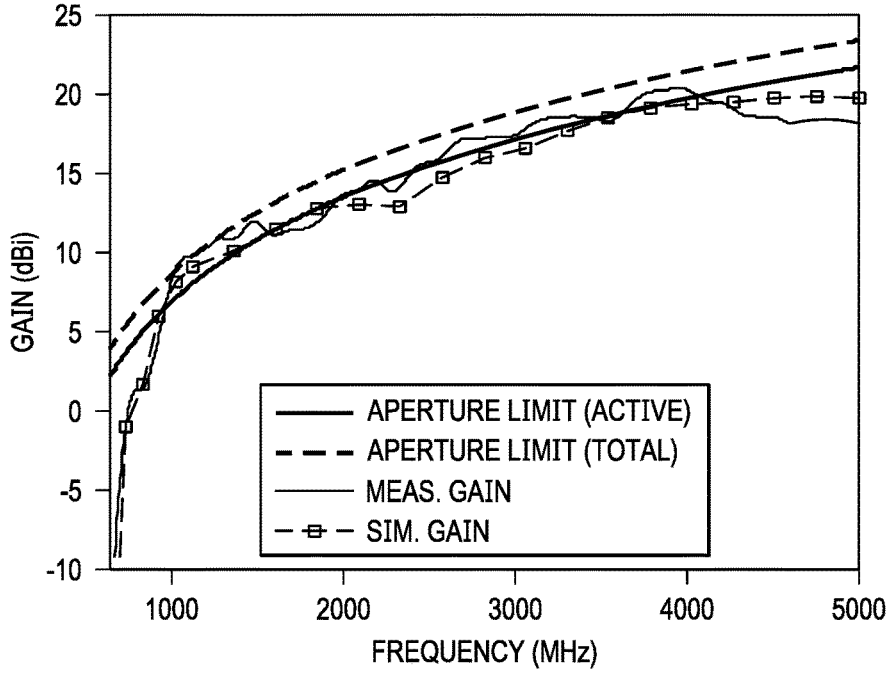
FIG. 9 is a graph of simulated and measured gain with respect to frequency for an exemplary embodiment.
Figure 10:
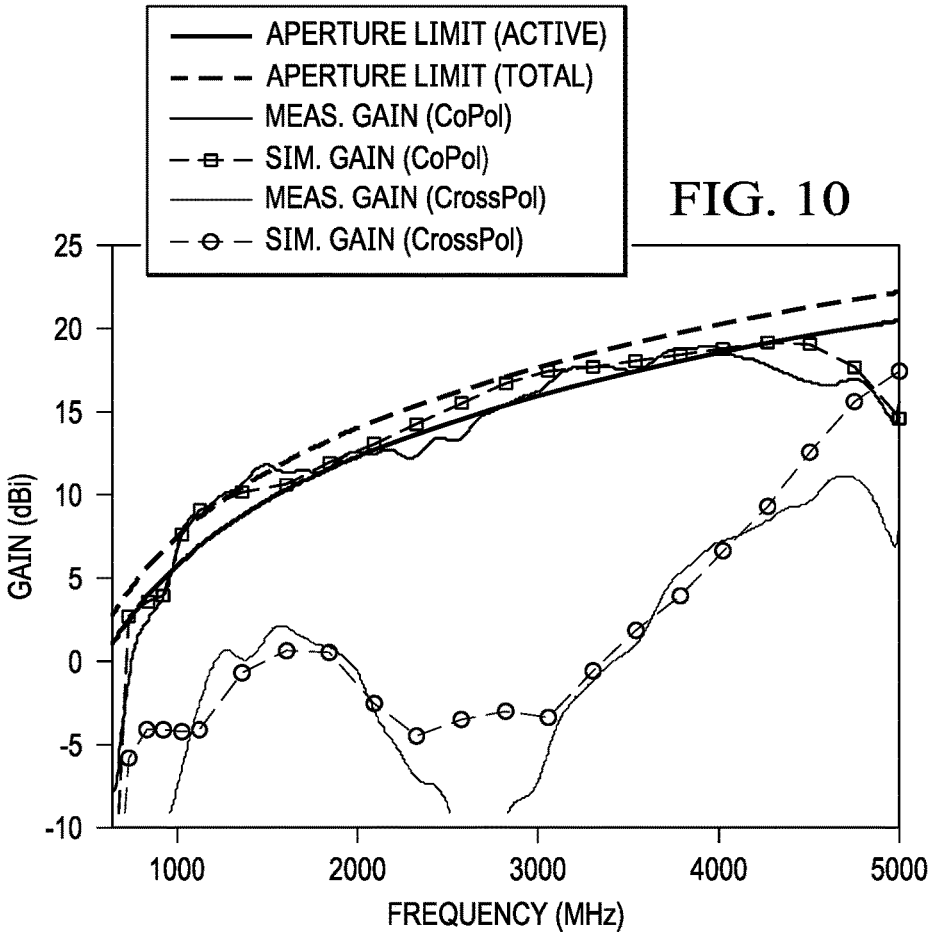
FIG. 10 is a graph of simulated and measured gain with respect to frequency for an exemplary embodiment.

Measured and simulated far-field gains are plotted for a beam scanned to broadside (FIG. 7), and to 45° in the E-, H-, and D-Planes (FIGS. 8-10 respectively). In this example, the simulated far-field gain is based on a semi-infinite model which may be periodic in the H-Plane and finite in the E-Plane, containing a full a row of 8 elements with extended dipoles. The cross-polarized gain, given by the 3rd Ludwig definition, is plotted for broadside (FIG. 7) and D-Plane (FIG. 10) scanning (E and H Plane cross-polarization is not shown but is low). Also plotted for comparison are the theoretical aperture gain limits based on the area of the actively fed elements as well as the total area including the extended dipoles. As is illustrated, the gain patterns are well-behaved over the entire band and scan volume, with low losses and no evidence of scan-blindness. Overall, this example of the array may be within 3 dB of the theoretical aperture limit over a 7.6:1 bandwidth (605-4630 MHz) at broadside and 6.6:1 bandwidth (665-4370 MHz) in all scan planes. The illustrated cross-polarization is also low, except above 4200 MHz in the D-Plane scan (FIG. 10). For applications requiring high polarization purity, a polarization bandwidth of 6.3:1 (665-4200 MHz) may be defined with cross-polarization of less than −10 dB.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A phased array antenna comprising:

a ground plane structure;

a plurality of dipole structures that each have a respective reactance and that are tightly coupled and adapted to function as an antenna, located above the ground plane structure; and a plurality of balun and matching networks that are each de-tuned and have a respective reactance and that are located such that the balun and matching networks are respectively in electrical communication with and are adapted to compensate for said respective reactances of the dipole structures, and each is contained within a same respective planar space available to the respective dipole structure such that each said planar space is substantially perpendicular to said ground plane structure.

2. The phased array antenna of claim 1, wherein each of the plurality of balun and matching networks is formed on the same substrate material as the dipole structure with which the balun and matching network is in electrical communication.

3. The phased array antenna of claim 2, wherein the substrate from which the dipole and matching network structures are formed is a multi-layer printed circuit board material.

4. The phased array antenna of claim 1, wherein the array antenna additionally comprises a dielectric superstrate material so located that the plurality of dipole structures are located between the superstrate material and ground plane structure.

5. The phased array antenna of claim 4, wherein the dielectric superstrate and ground plane structure are positioned in parallel, and of such size and alignment, that each edge of the dielectric superstrate is aligned with a corresponding edge of the ground plane structure.

6. The phased array antenna of claim 4, wherein the dielectric constant of the dielectric superstrate material is in a range of about 1.5-6.

7. The phased array antenna of claim 1, wherein the dipole impedance is adapted to be about 100 ohm.

8. The phased array antenna of claim 7, wherein the reactance of the balun network is adapted to function as a matching network for the phased array.

9. The phased array antenna of claim 8, wherein the balun networks are adapted to facilitate a bandwidth of about 7:1 or greater.

10. The phased array antenna of claim 9, wherein the balun networks are configured to have an input impedance in a range of about 25-200 ohm.

11. The phased array antenna of claim 1, wherein the plurality of dipole structures are spaced at about 30 mm×30 mm with an overall height of about 45 mm.

12. A method of creating a phased array antenna, comprising the steps of:

positioning a plurality of dipole antenna structures above a ground plane structure such that said dipole antenna structures are tightly coupled, each said dipole antenna structure having a respective reactance; and providing a plurality of balun and matching networks that are each de-tuned and have a respective reactance, said balun and matching networks in electrical communication with and compensating for said respective reactances of said dipole antenna structures, where each such network is contained within a same respective planar space available to the dipole antenna structure with which it is in electrical communication such that each said planar space is substantially perpendicular to said ground plane structure.

13. The method of claim 12, wherein the step of providing balun and matching networks comprises providing the plurality of dipole structures and balun and matching networks using three-layer printed circuit board material.

14. The method of claim 12, wherein the step of positioning a plurality of dipole antenna structures further comprises providing a dielectric superstrate positioned such that the plurality of dipole antenna structures is located between the dielectric superstrate and the ground plane structure.

15. The method of claim 14, wherein the step of positioning a plurality of dipole antenna structures comprises positioning the dielectric superstrate and ground plane structure such that they are co-planar and aligned such that corresponding edges are aligned.

16. The method of claim 14, wherein the dielectric superstrate has a dielectric constant in a range of about 1.5-6.

17. The method of claim 16, wherein the step of positioning a plurality of dipole antenna structures comprises reducing the E-plane dimension of the dipole antenna unit structures such that the impedance of the plurality of dipole antennas is lowered to a range of about 25-200 ohm.

18. The method of claim 17, wherein the step of configuring the balun and matching networks comprises configuring the balun networks and dipole antenna structures to have an input impendence in a range of about 25-200 ohm.

19. The method of claim 12, wherein the balun and matching networks are adapted to facilitate a bandwidth of about 7:1 or greater.

20. A phased array antenna comprising:

a dielectric superstrate formed from material with a dielectric constant in a range of about 1.5-6;

a ground plane structure positioned coplanar to the dielectric superstrate and of such size and alignment that each edge of the ground plane structure is aligned with a corresponding edge of the dielectric superstrate;

a plurality of dipole structures formed into a tightly coupled array and positioned above the ground plane structure and below the dielectric superstrate such that the phased array impedance is adapted to be in the range of about 25-200 ohm; and a plurality of balun and matching networks, each de-tuned and in electrical communication with at least one dipole structure, wherein the balun and matching networks are adapted have an input impedance in a range of about 25-200 ohm;

wherein the balun and matching networks are respectively in electrical communication with and are adapted to compensate for respective impedances of the dipole structures, and each is printed on a same respective printed circuit board substrate as the respective dipole structure such that each said printed circuit board substrate is substantially perpendicular to said ground plane structure and said dielectric superstrate.

21. The phased array antenna of claim 20, wherein the networks are adapted to combine matching and balun functions.

* * * * *